US005513400A

United States Patent [19]

Turner

[11] Patent Number: 5,513,400

[45] Date of Patent: May 7, 1996

[54] PRESSURE RELIEF MATTRESS

[76] Inventor: David R. Turner, 535 N. Corry St., Fort Bragg, Calif. 95437

[21] Appl. No.: 137,835

[22] Filed: Oct. 15, 1993

[51] Int. Cl.[6] ..... A47C 27/14

[52] U.S. Cl. ..... 5/451; 5/470; 5/481

[58] Field of Search ..... 5/450, 451, 452, 5/470, 481

[56] References Cited

U.S. PATENT DOCUMENTS

| | | | |
|---|---|---|---|
| 3,689,949 | 9/1972 | Weinstein et al. . | |
| 3,840,921 | 10/1974 | LaBianco | 5/452 |
| 4,055,867 | 11/1977 | Phillips | 5/452 |
| 4,057,862 | 11/1977 | LaBianco | 5/460 X |
| 4,187,566 | 2/1980 | Peterson | 5/451 |
| 4,317,244 | 3/1982 | Balfour-Richie | 5/470 X |
| 4,346,489 | 8/1982 | McMullan | 5/451 |
| 4,663,790 | 5/1987 | Santo | 5/452 |
| 4,713,852 | 12/1987 | Fox, Sr. et al. | 5/451 |
| 5,062,170 | 11/1991 | Johenning | 5/450 |
| 5,086,528 | 2/1992 | Miller | 5/451 |
| 5,136,741 | 8/1992 | Balonick et al. | 5/481 X |

FOREIGN PATENT DOCUMENTS

| | | | |
|---|---|---|---|
| 2154445 | 9/1985 | United Kingdom | 5/451 |

OTHER PUBLICATIONS

Classic Corp of Jessup, MD—Solo Flotation Bed with heater bladder to heat tubes w/o hot spots (©1984).

E. R. Carpenter Company, Inc. Makes a cover with extra large zipper hem. (1993).

*Primary Examiner*—Michael F. Trettel

[57] ABSTRACT

A pressure reduction mattress construction for a liquid or gel bed having a flexible basin (10) forming a cavity (20) with inclines head (16H) and foot (16F) for surrounding and supporting a liquid or gel filled flotation bladder (30) that is anchored (36) to the head of the basin (10). The inclines (16F & 16H) made of a soft yielding material allow the head or foot of the bed to be easily raised as the liquid or gel (48) moves toward the center of bed. The head incline (16H) also serves to provide a soft yielding surface to support a patient after liquid or gel (48) has naturally moved to the sacral area (21). The entire structure is then covered with a flexible and yielding hospital fabric cover (40), giving the bed the appearance of a conventional hospital mattress. In some disclosed embodiments, an optional heater pad (22) may be used with a fiber (25) filled sacral bladder (26) placed over the heater pad (22) to prevent complete displacement of water over heater pad (22). In other embodiments a sacral bladder (26) is used to provide extra support when sitting up.

13 Claims, 8 Drawing Sheets

PRESSURE RELIEF MATTRESS

BACKGROUND—FIELD OF THE INVENTION

This invention relates generally to waterbeds, gel beds, and more particularly to flotation beds or hybrid waterbeds.

BACKGROUND—DISCUSSION OF PRIOR ART

Waterbeds have been in existence for a long period of time. They have been used extensively for therapeutic treatment of patients with, or at risk of, pressure ulcers. They have also been used for burn patients. More recently waterbeds with soft foam sides and covered with mattress ticking, often referred to as hybrid or flotation mattresses, have been introduced.

A number of specially designed and constructed bed bases, supports, overlays, waterbeds, or mattresses (hereinafter for convenience called flotation mattresses) have been proposed in attempts both to prevent the incidence of pressure ulcers and to promote the rapid healing of pressure ulcers. These flotation mattresses, when comprised of one or more liquid filled or gel filled filled bladders, have been unable to articulate for patients' comfort, therapeutic positioning, or sitting up in an adjustable hospital bed, and at the same time provide flotation where needed while in various postures. In some proposed flotation mattresses several bladders or tubes have been held in place by various means. The surfaces of the bladders pull taught and uncomfortable when lifted. There is also stress on the means of holding the water in place as well as on the lifting mechanism. The various chambers or tubes often have to be re-positioned after raising the head of the bed. Thinner flotation mattresses have been unable to be economically heated. Pressure reducing die-cut foam flotation mattresses break down in the critical areas subject to pressure ulcers, and thereby loose their therapeutic value. Air loss systems are expensive, noisy and require adjustment and monitoring. All of the flotation mattresses designed for use on hospital beds to relieve pressure heretofore known suffer from a number of disadvantages:

a) Flotation mattresses that offer adequate pressure relief to all parts of the body are too heavy to place on standard hospital bed bases.

b) Raising the head of flotation mattresses in present use places unnecessary strain on the lifting mechanism.

c) If one raises the head of flotation mattresses in present use the support for the back is lost and the occupant is left without a comfortable backrest.

d) If one raises the head of flotation mattresses in present use the flotation bladder or bladders move out of position.

e) If one raises the head of flotation mattresses in present use the weight of the occupant is shifted to the sacral area which is not provided with additional support.

f) The use of fluid or gel compartments which are held in place result in a taught uncomfortable support surface and stress on the means of holding the liquid or gel in a vertical position.

g) Flotation mattresses with a butt seam construction have not been fitted with a baffle system that is securely tethered.

h) Flotation mattresses in use on hospital beds are unable to be easily and economically heated. They are shallow and the occupant can bottom out, resulting in direct contact with the heater pad.

i) Flotation mattresses in use have an exposed zipper which allows liquid and other contaminants to enter the flotation mattress and are difficult to clean.

j) A leak in flotation mattresses in use can spill over the foot of the mattress when the head is raised.

k) Die-cut foam pressure relief mattresses break down quickly.

There is still a need for an inexpensive durable flotation bed which provides a person relief from pressure in various postures. There is also a need to be able to heat such an articulating flotation bed.

OBJECTS OF THE INVENTION

The objects and advantages of the present invention are:

a) to use as little liquid as possible and still provide relief from pressure on the skin of the resting patient;

b) to provide means for displacing liquid or gel as head of mattress is raised so as to put little additional strain on lifting mechanism.

c) to provide a means of bringing a stable backrest into position as head of mattress is raised into sitting position.

d) to provide a means to hold a liquid filled bladder or bladders in place as the head of the bed is raised with out stress on the bladder or means of securing bladder;

e) to provide a self-supporting, flexible frame with a fluid or gel filled container or bladder that will provide relief from pressure while lying flat and also support a body when the head and/or foot is raised and continue to provide relief from pressure to all areas of the body;

f) to provide a comfortable pressure relieving flotation mattress that does not need to hold water or gel in place as head of mattress is raised.

g) to provide means of tethering a baffle or motion reducing mechanism in a fluid filled flotation mattress constructed with butt seams;

h) to provide a method of economically and simply heating an articulating flotation mattress.

i) to provide a cover that will protect the zipper and inside of the flotation mattress from fluid and be easy to clean;

j) to provide a containment system so that liquid will not escape over the foot of the flotation mattress in case of a leak while flotation mattress head is in the raised position;

k) to provide a durable pressure relief mattress.

Further objects and advantages of the present invention are to provide a pressure relief flotation mattress that is inexpensive to manufacture and easy to use. Still further objects and advantages will become apparent from a consideration of the drawings and ensuing description.

SUMMARY OF THE INVENTION

The present invention relates to hybrid waterbed or gel mattresses. A bladder containing liquid is restrained laterally by two flexible soft sides and two inclines of flexible soft material at the head and foot; all attached to and supported by a flexible soft base. In the present embodiment, various densities of flexible polyurethane foam are used for the sides, inclines and base.

The flotation mattress construction is disclosed having a soft flexible base and frame assembly which when placed on a hospital bed base or other foundation is entirely self supporting and will retain its pressure reduction qualities over prolonged use.

The base in its present embodiment is high-density foam, 1" by 36" by 76".

The sides in their present embodiment are two truncated foam wedges that are approximately 5" high, 2" wide at the top, and 5" wide at the bottom. The outside wall is a vertical plane, while the inside wall is sloped inward. The bottom of the sides rest on the foam base. This shape provides for a smaller surface of the sides being exposed to the resting area of the flotation mattress. It also provides greater structural integrity to contain the fluid or gel filled bladder.

The head and foot inclines in their present embodiment are two identical foam wedges that are 5" high and slope toward the center of the bed approximately 28". Two additional oblique wedges of foam are attached to the head incline to form a cavity for the bladder smaller at the head, much like the shape of the human body.

The bladder in its present embodiment comprises three sheets of flexible film butt welded together to form a container for liquid with an internal membrane. The two outer membranes are cut so that when welded together they form an envelope or bladder that will loosely encompass the cavity formed by the basin. The middle membrane is cut to substantially the mid-height dimension of the cavity and perforated with one or several large voids. Attached to the middle membrane is a woven fiber material that dampens the wave action of the liquid. The head edge of the bladder is trimmed with an extra flange protruding enough in which to place grommets. These grommets are then used to anchor or tether the head portion of the bladder to the incline and base.

Upon raising the head of the flotation mattress, the liquid or gel is displaced to the middle of the bed, providing extra support under the sacral of the occupant. The bladder remains in place, with no strain on the bladder, flange nor anchor.

The head incline automatically displaces the water so that the lifting mechanism must lift virtually no additional weight.

As the head is raised, the head incline automatically replaces the fluid or gel as a back support, making sitting up in bed as easy as on a standard hospital mattress, yet still relieving pressure in the sacral area.

The base, side rails and inclines are then covered by a form fitted vinyl liner to protect the foam and capture any liquid that might escape. A secondary boot liner is placed over the foot end of the liner to prevent any leakage outside of the primary liner when the head is raised and the level of liquid at the foot of the mattress is above the primary liner. Comprised of two sheets of vinyl sealed on three sides, the boot liner slides over the foot of the bladder.

A smaller sacral bladder is manufactured with a fiber batt sealed inside. It is filled with fiber and liquid and placed in the center of the bed, between the head and foot inclines. This bladder prevents the patient from displacing all water beneath the sacral area providing another level of flotation. This sacral bladder also enables the use of a heating pad which is placed directly under it. The fiber in the sacral bladder will prevent the liquid from being totally displaced, thus avoiding the danger of creating a hot spot.

The entire assembly is then encased in a cover made of a hospital fabric that is flexible and conforming. In the present embodiment this cover has a zipper which goes 360 degrees around the bottom of the cover. The hem above the zipper is made wider than usual, so that it covers the entire zipper. Fluids that might drip down the side of the fluid proof cover will drip past the zipper.

Reference Numerals In Drawings

Figure 1:
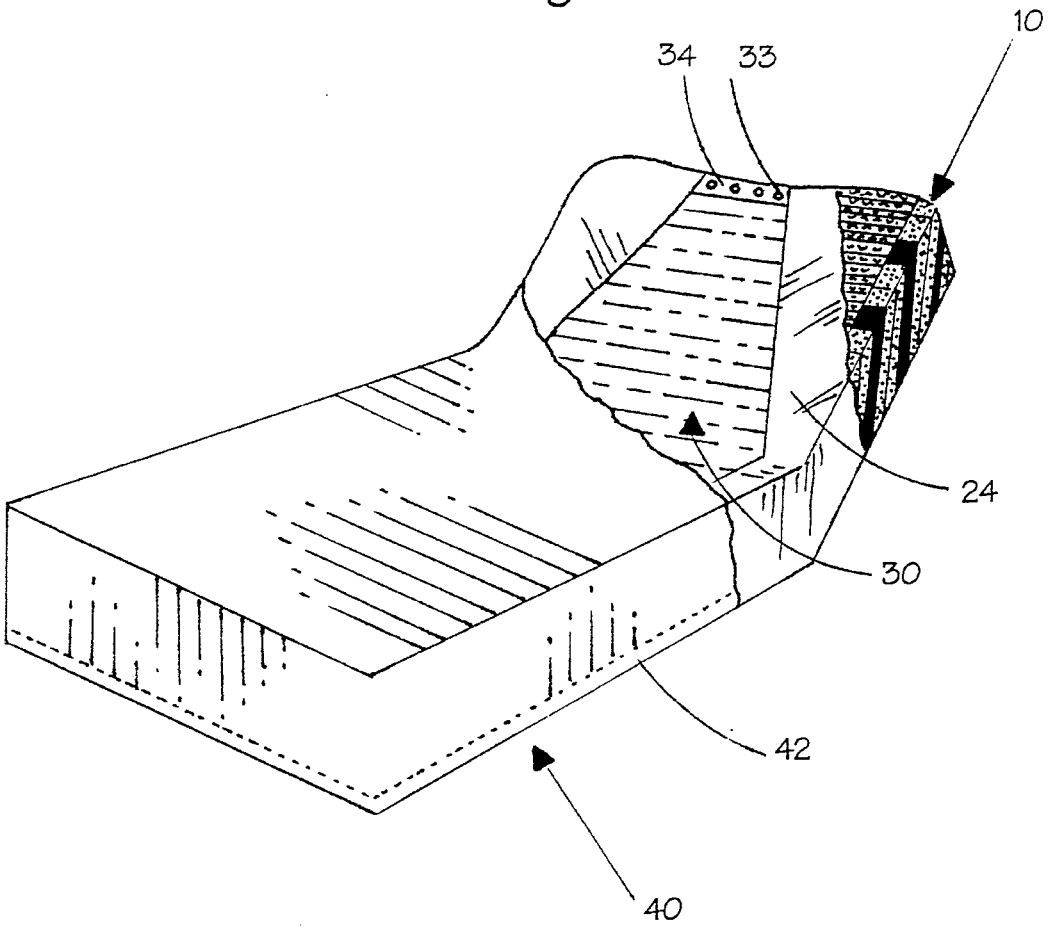
FIG. 1 is a perspective view, partially cut away, of partially articulated pressure relief mattress of the present invention.

10 basin
12 base
14 side rails right(r) & left(1)
16 inclines head(H) & foot(F)
18 oblique wedges right(r) & left(1)
20 cavity
21 sacral area
22 heater pad
24 liner
25 fiber
26 sacral bladder
28 sacral bladder valve
29T top film/membrane
29B top film/membrane
30 flotation bladder
31A middle film/membrane
31B fiber
32 bladder valve
33 grommets
34 flange
35 ties
36 anchor assembly
37 anchor
38 boot liner
40 cover
41 zipper
42 zipper hem
44 zipper pulls
48 liquid or gel
50 air frame
52 air chamber
54 liquid chamber
56 inclined plane—head(H) and foot(F)
58 air frame incline chamber—head(H) and foot(F)
60 air frame valves
62 fill
64 extended flange/sleeve
66 butt weld
68 anchor material
70 die cut

DESCRIPTION OF THE PREFERRED EMBODIMENT—FIGS. 1 to 5

Until now, neither waterbeds nor flotation or hybrid mattresses containing water or gel have been able to both provide adequate pressure relief and articulate to a comfortable sitting up position.

Referring now to FIG. 1 there is shown the partially cut away pressure relief mattress of the present invention in an articulated position. Pressure relief mattress is designed with a cover 40 of hospital fabric which is fluid proof, bacteria resistant, fire resistant, supple and conforming. Cover 40 opens by way of a zipper 41 (shown in FIG. 3) which is covered by a zipper hem 42 all around the bottom edge of pressure relief mattress to allow for full opening of pressure relief mattress and access to the various components which will be described more fully hereinafter. A primary flotation bladder 30 rests in a vinyl liner 24 and a basin 10. The head end of flotation bladder 30 has a flange 34 with grommets 33 for tethering to head portion of flotation mattress.

Figure 2:
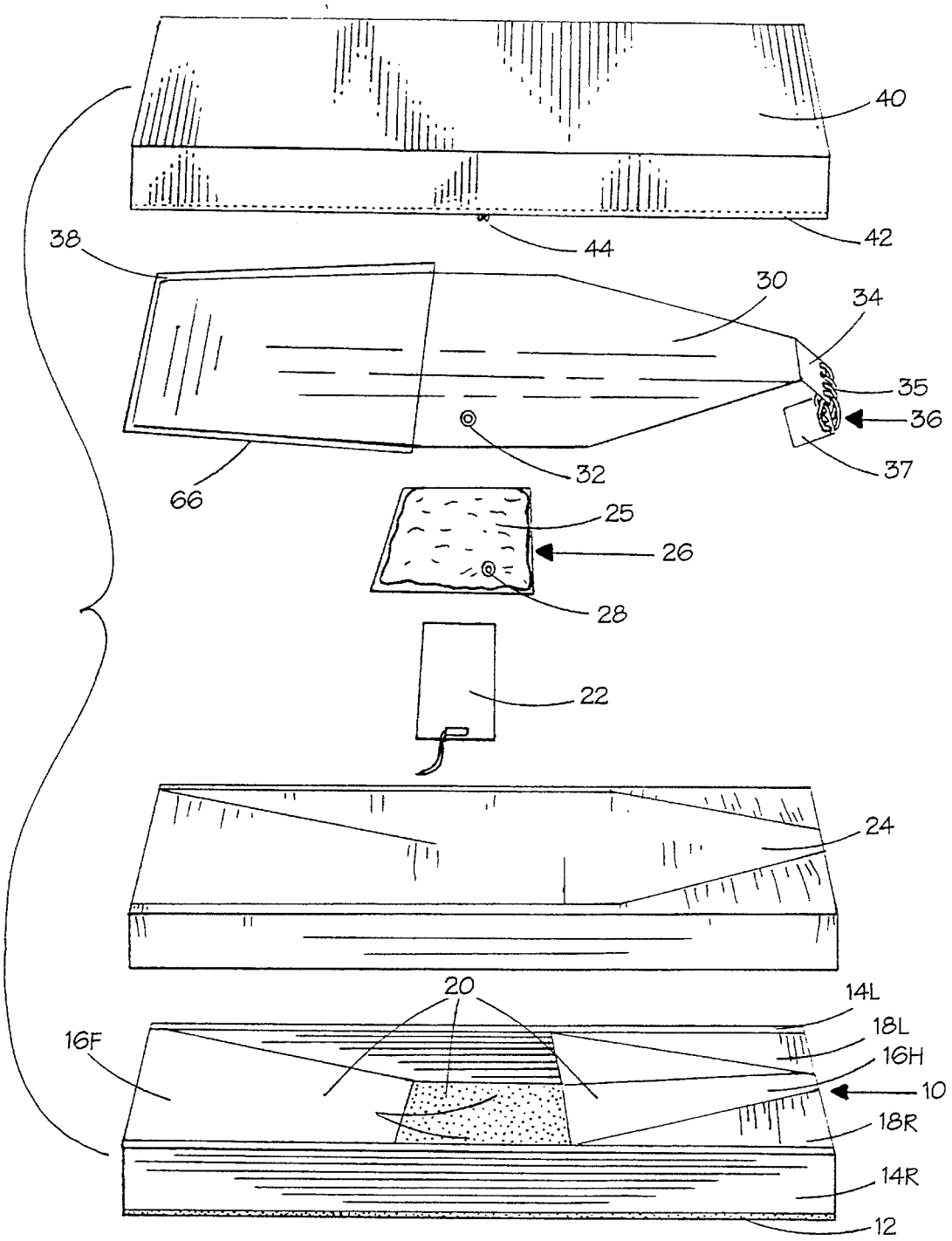
FIG. 2 is an exploded view of the pressure relief mattress of the invention, showing the various components.
Figure 3:
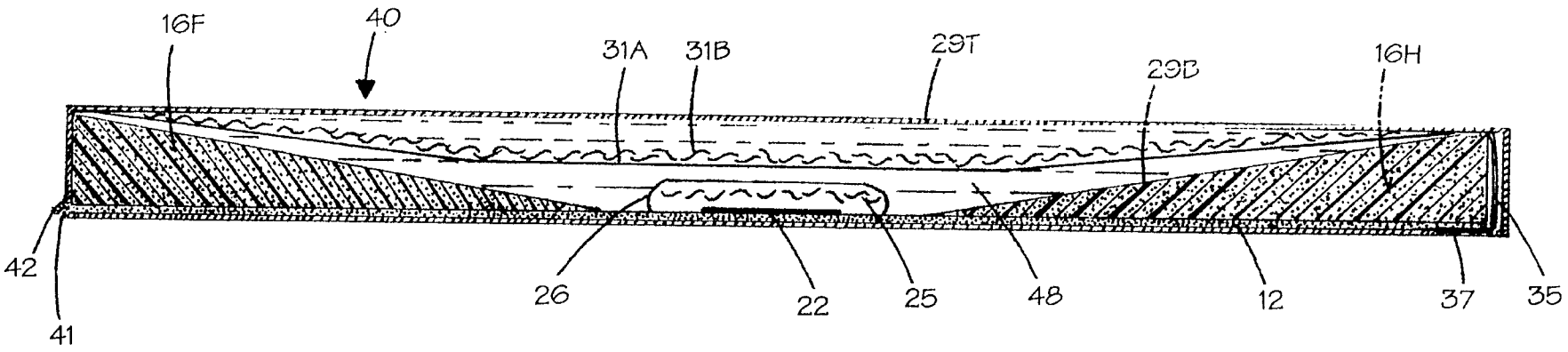
FIG. 3 is a cross-sectional elevational view of the pressure relief mattress of the invention.

The pressure relief mattress of the present invention has a number of separate and distinct components illustrated in FIG. 2. and FIG. 3. In these figures there is shown basin 10 which in this embodiment is made up of seven pieces of foam in different densities glued together: a foam base 12, a pair of side rails 14R, 14L (right and left), a head incline 16H, a foot incline 16F, and an oblique wedge or wedges 18R, 18L (right and left). Important features of this invention are the head incline 16H and foot incline 16F.

Liner 24 covers the inside, upper, and outer surfaces of basin 10, wrapping approximately two inches under base A heater pad 22 may be placed on top of liner 24 in a sacral area 21 between head incline 16H and foot incline 16F.

A sacral bladder 26 is placed over sacral area 21 which will place it directly above heater pad 22 and liner 24. Sacral bladder 26 is an important part of this invention. Sacral bladder 26 consists of two sheets of vinyl (flexible polyvinyl chloride film) lap welded together around a piece of fiber 25 to form a container for liquid. A sacral bladder valve 28 is provided to fill bladder 26 with liquid.

Figure 4:
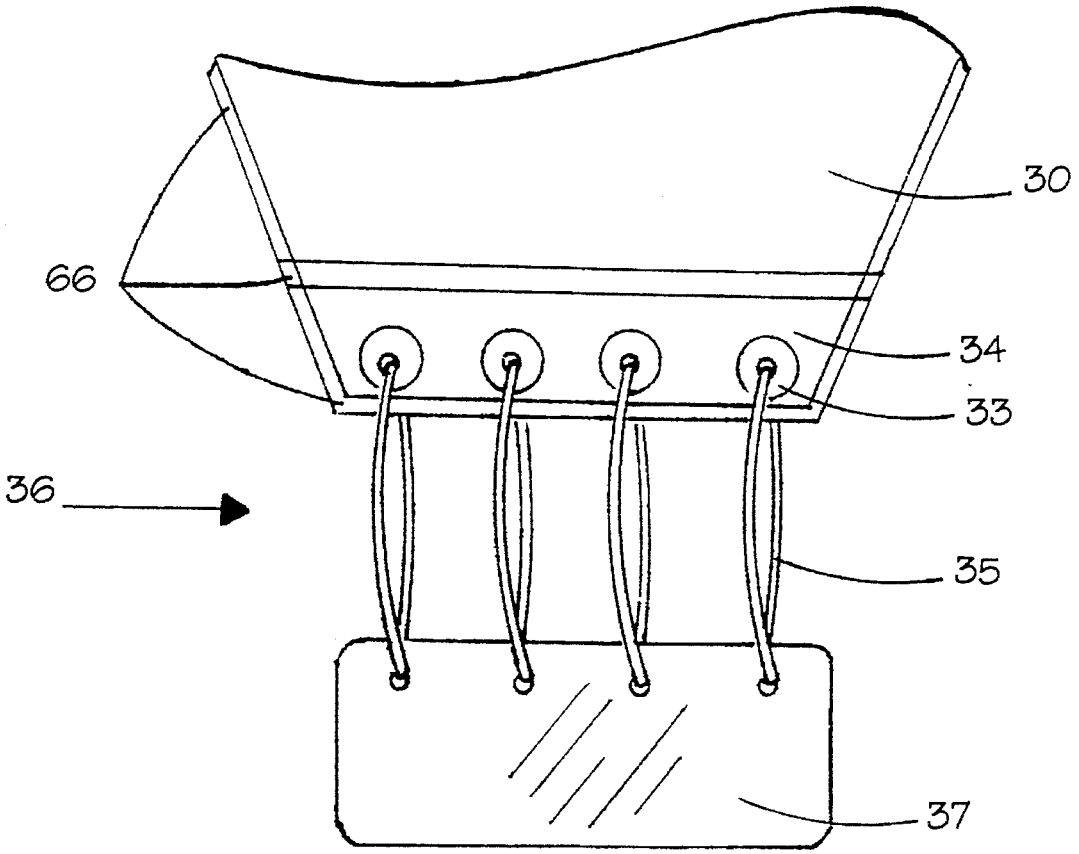
FIG. 4 is an illustration of the flotation bladder anchor assembly.

Flotation bladder 30 consists of three sheets of vinyl (flexible polyvinyl chloride film) joined together with a butt weld 66 to form a container for liquid with an internal membrane. The top & bottom membranes 29T & 29B are cut so that when welded together they form an envelope or bladder that will loosely encompass the cavity formed by the basin 10. The middle membrane 31A is cut to the mid-height dimension of cavity and perforated with several large holes or voids. Attached to the middle membrane 31A is a fiber 31B material that dampens the wave action of the fluid. This middle membrane 31A is an important part of this invention. The head edge of flotation bladder 30 is trimmed with an extra flange 34 protruding enough in which to place a grommet or grommets 33. As is illustrated in FIG. 4, flange 34 and grommets 33 are then used to anchor or tether the head portion of the flotation bladder 30 to basin 10 by means of a tie or ties 35 and anchor 37. Anchor 37 is placed between bottom of basin 10 and cover 40. In the preferred embodiment, the anchor 37 and ties 35 are made of plexiglass and polyethelyne tubing respectively. Flange 34, ties 35, and anchor 37 are important parts of this invention. The vinyl film of the flotation bladder 30 is designed to allow liquid 48 to fill the remainder of cavity 20 formed by basin 10 yet lay loose on top to provide maximum bodily displacement. A bladder valve 32 is provided to fill bladder 30 with liquid 48.

A boot liner 38 is made of two sheets of vinyl (flexible polyvinyl chloride film) joined together with a butt weld 66 to form a boot or cap. Boot liner 38 slips over the foot end of bladder 30. Boot liner 38 is an important part of this invention.

Figure 5:
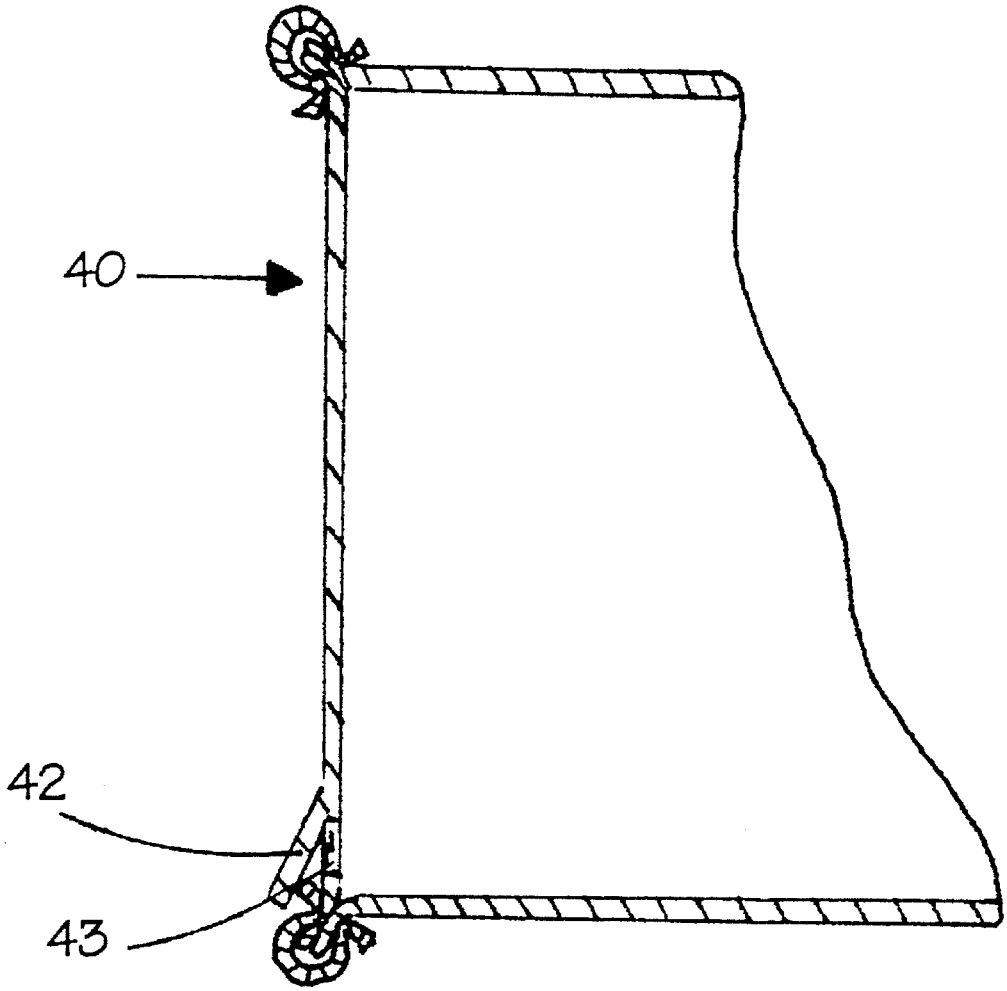
FIG. 5 is a partial side view of the cover, zipper, and zipper hem.

Cover 40 encompasses all of basin 10 and various components. It consists of a fluid proof, bacteria resistant, fire resistant, supple and conforming hospital fabric. As is shown in FIG. 5, said cover 40 includes zipper 41 at the bottom edge that goes 360 degrees around pressure relief mattress. Extra wide zipper hem 42 is sewn over the entire top edge of zipper 41. Zipper hem 42 is an important part of this invention.

Theory of Operation

The manner of using my pressure relief mattress of the present invention requires no greater effort on the part or the patient or nursing staff than does a regular hospital mattress with the exception of having the ability to control the temperature of the sleeping environment. In fact, my pressure relief mattress requires less nursing attendance due to its pressure relief characteristics.

When a patient lies on my pressure relief mattress, the fluid is automatically displaced and pressure on the skin is spread over more of the body. The resulting pressure over the body is less than that which would cut off blood circulation and cause pressure sores. Important parts of this invention are foot incline 16F & head incline 16H and the manner in which they displace the liquid or gel 48 to sacral area 21 when the head or foot of the hospital bed is raised. As the head of the bed is lifted, there is virtually no added weight for the mechanism to lift because of incline's 16H feature of zero liquid or gel 48 at the outer edge. At the same time head incline 16H is displacing liquid 48, it begins to offer the patient comfortable support as a back rest. The displaced fluid has now naturally moved to sacral area 21 where the patient, when sitting up, needs additional sacral pressure relief. In addition, liquid 48 in flotation bladder 30 swells beneath the knees, causing the patient to assume a healthy posture of knees up and apart.

Anchor assembly 36 holds flotation bladder 30 in place as the head of the bed is raised. Fiber 31B slows down the motion of the fluid. Middle membrane 31A keeps the fiber 31B from shifting out of position.

Sacral bladder 26 prevents the patient from ever bottoming out on heater pad 22 (which could cause overheating) or foam base 12 which could cause pressure ulcers. This protection from bottoming out provided by sacral bladder 26 allows flotation bladder 30 to be under-filled for maximum bodily displacement with out fear of touching heater pad 22 or foam base 12.

Boot liner 38 serves to keep any leakage from the foot end of flotation bladder 30 from escaping outside the system while the head of pressure relief mattress is raised and the fluid is displaced to area 21 and foot of flotation bladder 30.

An incontinent patient, liquid spills, wound seepage, etc. will not cause harm to my pressure relief mattress. The cover is made of a fluid-proof bacteria resistant hospital fabric. An extra wide zipper hem 42 at the top of the zipper 43 shields the zipper 6 from escaped bodily fluids or other liquids that might drip down the outside of the cover 40. The fluids will pass over the hem 42 and past the zipper 43.

Conclusion, Ramifications, and Scope of the Invention

Thus, the reader will see that the pressure relief mattress of the present invention provides a patient with the benefits of flotation support while being able to be articulated into a sitting position. Furthermore, the pressure relief mattress has the additional advantages in that

Figure 6:
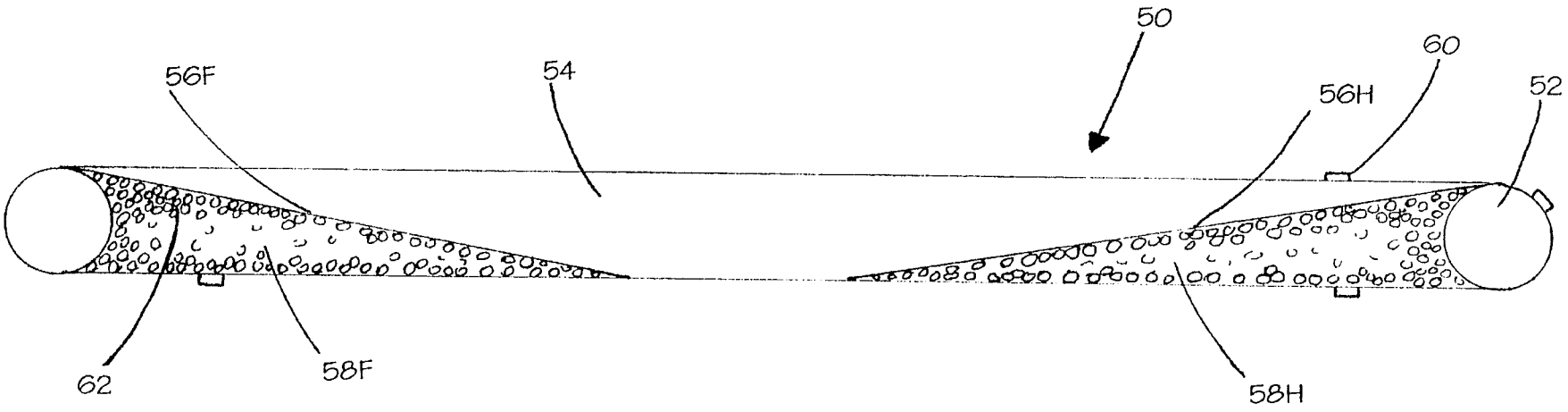
FIG. 6 is a cross sectional elevational view of an air frame embodiment of the present invention.
Figure 7:
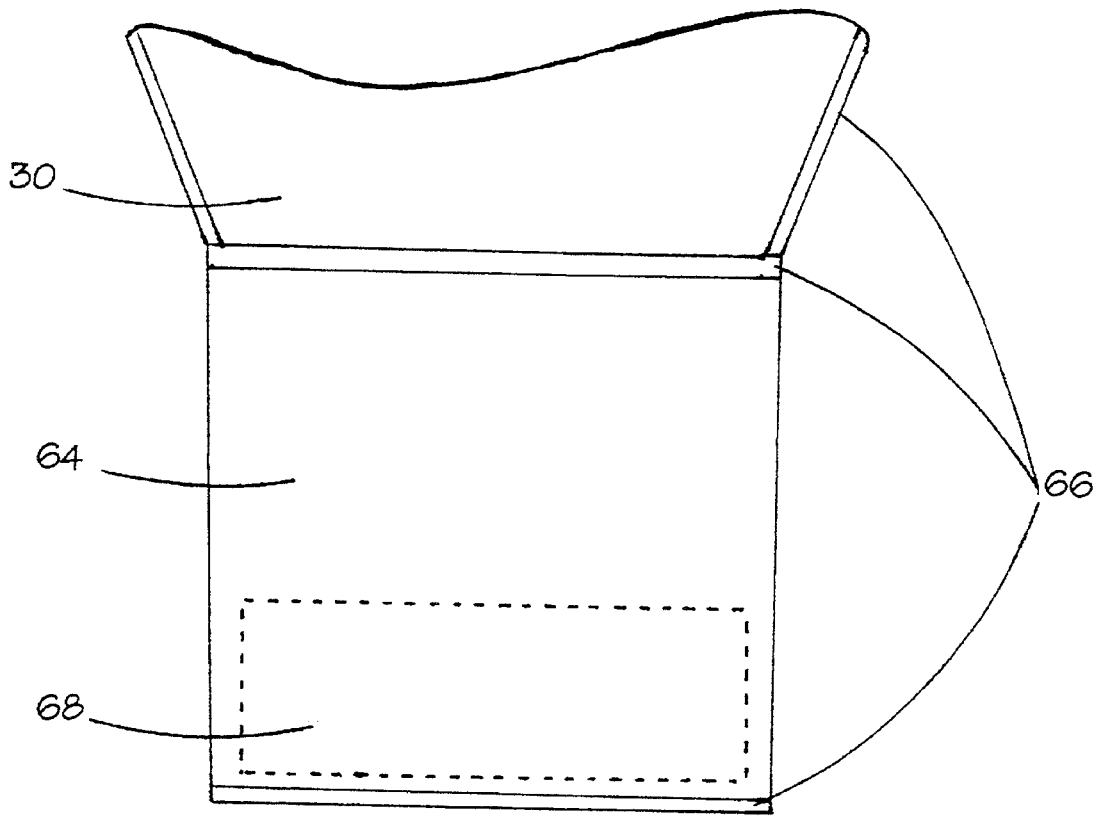
FIG. 7 is an illustration of the extended flange/sleeve embodiment of the flotation bladder anchor assembly.
Figure 8:
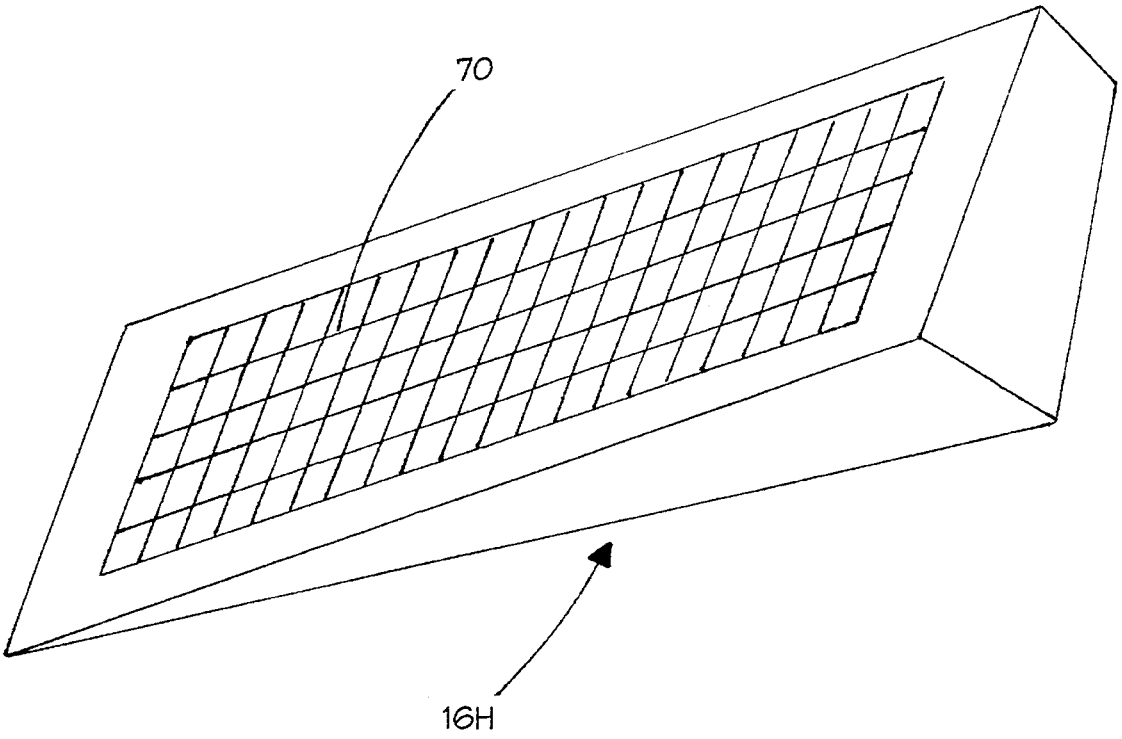
FIG. 8 is a perspective view of a die cut embodiment of head incline.

* it allows the economical heating of the pressure relief mattress;
* it provides flotation with a minimum of liquid or gel, resulting in a lighter flotation mattress;
* it provides a means for keeping flotation bladder in place while head is raised;
* it provides a means for capturing any leakage at foot of bed when water level is above top level of basin;
* it provides a means of preventing fluid from leaking into flotation mattress through zipper;
* it allows for the tethering of baffles in a butt seamed flotation bladder;

While my above description contains many specificities, these should not be construed as limitations on the scope of the present invention, but rather as an exemplification of one preferred embodiment thereof. Many other variations are possible. For example:

The basin 10 could be made with different shaped and sized base 12, sides rails 14R & 14L, and/or oblique wedges 12R & 12L;

Or the inclines 16H & 16F discussed above could also be of different dimensions, ranging anywhere between 20 inches to 50 inches in length; Inclines 16H & 16F could be varied for different body types to even further regulate the volume of water to body weight; In addition, inclines 16H & 16F could be made of another material such as air chambers, convoluted or die-cut foam 70 (as shown in FIG. 8), foam rubber, etc.;

As illustrated in FIG. 6, the entire basin 10 could be made of rectangular chambered flexible film and filled with air and a liquid chamber 54 created by covering the basin with a sheet of flexible film, sealed at the air chamber 52. This construction is revealed in the prior art and commonly referred to as an air frame waterbed 50. Two afferent inclines 56H & 56F of flexible film could be welded into place, creating an air frame head incline 58H and an air frame foot incline 58F and filled with a fill substance 62 such as air, styrofoam pellets, foam, etc.;

In another embodiment, the flotation bladder 30 would be made without a middle membrane 31A and without fiber to slow down the liquid 48. The flotation bladder 30 could also be made of another flexible material;

As is shown in FIG. 7, flange 64 of mattress 30 could be extended to wrap around basin 10 itself. A pocket or sleeve 64 could be seamed in the end of the extended flange in which a substance 68 such as foam, cardboard, closed cell foam, etc. could be inserted which would keep the flotation bladder 30 in place;

In yet another embodiment, flotation bladder 30 could be sealed with lap seams. The corners at the top of the flotation bladder 30 could be tethered in one of the many methods developed for tethering internal baffles, such as discussed by Johennings in U.S. Pat. No. 5,062,170. Any method heretofore invented for the tethering of an internal baffle in a waterbed could be used to tether the head of the flotation bladder 30 to the basin 10.

Accordingly, the scope of the invention should be determined not by the embodiment illustrated, but by the appended claims and their legal equivalents.

What is claimed is:

1. A hybrid mattress construction with a soft, flexible basin adapted for use with an adjustable frame, the improvement comprising:

a cavity formed by said basin;

a flotation bladder formed to fit into said cavity;

means for displacing liquid in said bladder and serving as a backrest as the head end of the frame is raised, including an afferent head incline; and, means to provide extra support under the sacrum and to prevent bottoming out, including a smaller, sacral bladder which is placed under said flotation bladder in a sacral area of said cavity.

2. The mattress construction according to claim 1, further including means for further preventing bottoming out and insuring that liquid in said sacral bladder will remain, including a woven fiber filling in said sacral bladder.

3. The mattress construction according to claim 1 further including a heater pad placed under said sacral bladder to provide heat for said flotation mattress without danger of a person bottoming out or coming into contact with said heater pad.

4. The mattress construction according to claim 1, wherein said head incline is formed by an afferent wedge with a substantially planar base surface having a length in the range of 20 inches to 50 inches and a substantially planar load-receiving surface diverging therefrom at a substantially acute angle between 7 degrees and 40 degrees, and a substantially planar head end surface having a height from about 3 inches to 16 inches.

5. The mattress construction according to claim 4 wherein said head incline is made of flexible polyurethane foam.

6. The mattress construction according to claim 4 wherein said head incline is made of flexible polyurethane foam that is die-cut whereby said head incline is a more conforming surface.

7. The mattress construction according to claim 1, further including an afferent foot incline forming part of said cavity.

8. A hybrid mattress construction with a soft, flexible basin adapted for use with an adjustable frame, the improvement comprising:

a cavity formed by said basin;

a flotation bladder formed to fit into said cavity;

means for displacing liquid in said bladder and serving as a backrest as the head of the frame is raised, including an afferent head incline;

wherein said flotation bladder comprises top, middle, and bottom sheets of flexible film butt welded together to form said bladder with a middle membrane therebetween said top and bottom sheets of said flexible film dimensioned so that when welded together said top sheet and bottom sheet form said bladder, said middle membrane extending to the mid-height dimension of said cavity and perforated with at least one opening and joined with a sheet of wave dampening material whereby the wave action of the liquid is slowed.

9. A hybrid mattress construction with a soft, flexible basin adapted for use with an adjustable frame, the improvement comprising:

a cavity formed by said basin;

a flotation bladder formed to fit into said cavity;

means for displacing liquid in said bladder and serving as a backrest as the head of the frame is raised, including an afferent head incline; and, a boot liner consisting of two sheets of flexible film welded on three sides to the approximate dimensions of a foot end of said flotation bladder and slipped over said foot end of said flotation bladder to keep any leakage from spilling out of said cavity when said head end is raised and water is transferred to the medial portion and foot end of said flotation bladder.

10. A hybrid mattress construction with a soft, flexible basin adapted for use with an adjustable frame, the improvement comprising:

a cavity formed by said basin;

a flotation bladder formed to fit into said cavity;

means for displacing liquid in said bladder and serving as a backrest as the head end of the frame is raised, including an afferent head incline; and, a cover made of fluid proof material that encases said basin and said flotation bladder with a zipper to facilitate opening and closing said cover, including a hem of said fluid proof material at a top edge of said zipper that is large enough to cover the entire extent of said zipper so that fluid dripping down a side of said cover is carried past said zipper.

11. A flotation mattress construction including a liquid filled bladder and means for raising one end of said bladder, the improvement comprising;

means for externally tethering said bladder to a head portion of the flotation mattress construction;

said bladder being formed of butt welded flexible film and leaving a predetermined length of untrimmed flexible film as a flange, said flange having attachment means for attachment at its head end;

wherein said means for tethering said flotation bladder includes grommets placed in said flange.

12. A flotation mattress construction including a liquid filled bladder and means for raising one end of said bladder, the improvement comprising;

means for externally tethering said bladder to a head portion of the flotation mattress construction;

said bladder being formed of butt welded flexible film and leaving a predetermined length of untrimmed flexible film as a flange, said flange having attachment means for attachment at its head end; further including an anchor tethered to said attachment means.

13. A flotation mattress construction including a liquid filled bladder and frame means for raising one end of said bladder, the improvement comprising;

means for externally tethering said bladder to a head portion of the flotation mattress construction;

said bladder being formed of butt welded flexible film and leaving a predetermined length of untrimmed flexible film as a flange, said flange having attachment means for attachment at its head end;

said flange having a predetermined length and a pocket formed in said flange for receiving an anchor member adapted to engage said frame means to anchor said bladder to a head end of said flotation mattress construction.

* * * * *